US007140401B2

(12) United States Patent
Wilcox et al.

(10) Patent No.: US 7,140,401 B2
(45) Date of Patent: Nov. 28, 2006

(54) TRANSFER DEVICE AND CAP ASSEMBLY FOR USE WITH A CONTAINER AND THE TRANSFER DEVICE

(75) Inventors: Alun Wilcox, Richmond (GB); Steven McLellan, West Ealing (GB)

(73) Assignee: Bristol-Myers Squibb Company, Princeton, NJ (US)

( * ) Notice: Subject to any disclaimer, the term of this patent is extended or adjusted under 35 U.S.C. 154(b) by 202 days.

(21) Appl. No.: 10/498,831

(22) PCT Filed: Dec. 17, 2002

(86) PCT No.: PCT/US02/40596

§ 371 (c)(1),
(2), (4) Date: Sep. 13, 2004

(87) PCT Pub. No.: WO03/051761

PCT Pub. Date: Jun. 26, 2003

(65) Prior Publication Data

US 2005/0016626 A1 Jan. 27, 2005

Related U.S. Application Data

(60) Provisional application No. 60/359,917, filed on Feb. 26, 2002, provisional application No. 60/341,733, filed on Dec. 17, 2001.

(30) Foreign Application Priority Data

Aug. 20, 2002 (EP) ..... 02018206

(51) Int. Cl.
*B65B 1/04* (2006.01)

(52) U.S. Cl. ..... 141/2; 141/329; 141/383; 141/27; 604/411; 604/416

(58) Field of Classification Search ..... 141/2, 141/21–27, 329, 330, 59; 604/411–416
See application file for complete search history.

(56) References Cited

U.S. PATENT DOCUMENTS

| | | | | |
|---|---|---|---|---|
| 2,627,857 A | | 2/1953 | Marcelli | |
| 4,576,211 A | | 3/1986 | Valentini et al. | |
| 5,114,030 A | | 5/1992 | Conard | |
| 5,279,583 A | * | 1/1994 | Shober et al. | 604/198 |
| 5,304,165 A | * | 4/1994 | Haber et al. | 604/411 |
| 5,334,179 A | * | 8/1994 | Poli et al. | 604/403 |
| 5,810,792 A | | 9/1998 | Fangrow, Jr. et al. | |

(Continued)

FOREIGN PATENT DOCUMENTS

| | | |
|---|---|---|
| EP | 0114677 | 8/1984 |

(Continued)

*Primary Examiner*—Steven O. Douglas
(74) *Attorney, Agent, or Firm*—Elliott Korsen

(57) ABSTRACT

The present invention is directed to a transfer device for fluid communication between a first site and a second site comprising a housing, a fluid channel and typically a sleeve assembly. The housing has a first end being connectable to the first site, a second end being connectable to the second site and a longitudinal portion extending between the first and second ends and defining a longitudinal axis. The housing includes two oppositely arranged wings comprising engaging means for engagement with the first site. The fluid channel is provided in the housing for fluid communication between the first end and the second end of the housing. The optionally provided sleeve assembly is mounted to the housing and axially movable relative to and biased against the housing.

42 Claims, 7 Drawing Sheets

U.S. PATENT DOCUMENTS 5,976,115 A * 11/1999 Parris et al. ..... 604/533

FOREIGN PATENT DOCUMENTS

| | | |
|---|---|---|
| EP | 0126718 | 11/1984 |
| EP | 0544654 | 6/1993 |
| EP | 0829249 | 3/1998 |
| EP | 0829250 | 3/1998 |
| EP | 0904763 | 3/1999 |
| JP | 339162 | 2/1991 |
| WO | WO 90/14798 | 12/1990 |
| WO | WO 97/10156 | 3/1997 |
| WO | WO 98/13006 | 4/1998 |
| WO | WO 98/32411 | 7/1998 |
| WO | WO 98/37854 | 9/1998 |
| WO | WO 00/35517 | 6/2000 |
| WO | WO 02/11794 | 2/2002 |

* cited by examiner

PRE-ASSEMBLE COLLAR CAP ONTO COLLAR

LOCATE COLLAR SUB-ASSEMBLY OVER VIAL

PUSH COLLAR ASSEMBLY ONTO VIAL

PUSH COLLAR CAP DOWN TO LOCKING POSITION

UPPER SECTION OF COLLAR CAP IS REMOVED

300mg

100mg

30mg

TRANSFER DEVICE AND CAP ASSEMBLY FOR USE WITH A CONTAINER AND THE TRANSFER DEVICE

This application claims priority benefit under Title 35 § 119(e) of U.S. provisional Application No. 60/341,733 filed Dec. 17, 2001 and U.S. provisional Application No. 60/359,917 filed Feb. 26, 2002. The present invention relates to a transfer device and in particular to a transfer device for fluid communication between a first site and a second site. Moreover, the present invention relates to a cap assembly for use with a container and a transfer device.

EP-A-0 114 677 discloses a connector comprising a tubular body portion, in which a plug carries a pointed needle. The body portion has external projections which carry deflectable locking arms for engagement with an injection site when the needle is inserted into a septum of the site. The arms prevent accidental disengagement of the needle from the septum.

EP-A-0 544 654 relates to a blunt cannula device whose piercing member cannot accidentally disengage from the septum in use. The blunt cannula device disclosed in EP-A-0 544 654 comprises a pair of locking members wherein each locking member is a manually operable spring-like deflectable arm having manually grippable means at one end and means at the opposite end for engagement with the injection site when the piercing member of the cannula device is inserted into the septum. Furthermore, the cannula device comprises a cross member having the body portion extending from one side thereof and the piercing member extending from the opposite side thereof such that the cross member extends radially between the body portion and the piercing member. Each locking member is fixed between its ends to a respective end of the cross member.

WO 98/37854 discloses a cap assembly for a container having a penetrator disposed within a cavity of the housing of the cap assembly. The penetrator is moveable between a retracted position completely within the cavity of the housing and an extended position in which the penetrator projects from the lower end of the hollow housing. If a syringe is engaged with a luer lock thread system on the housing, and if relative rotation is effected between the syringe and the container, the male member of the syringe moves downwardly against the upper end of the penetrator. This pushes the penetrator downwardly along the cavity in the housing.

WO 98/32411 discloses a luer connector comprising a luer connectable to a syringe and which extends to a sharpened end capable of being driven through a punctuable vial closure. The luer connector further comprises a luer support being mountable on a vial, and which initially supports the luer in a first position in which the sharpened end of the conduit is pointed toward the closure. Finally, the connector comprises a luer driver such that movement of the driver relative to the support causes the luer to be driven so that the sharpened end punctures the closure and enters the vial.

EP-A-0 829 249 relates to a vial connector assembly for transfer of a liquid. The connector assembly comprises a transfer tube that is slideably moveable between a distal position and a proximal position.

JP-A-03-039162 describes an injection drug dissolving solution container comprising an injection needle having two liquid passages. In use, one of the two passages becomes the passage of the dissolving solution, and the other of the two passages becomes that of air.

EP-A-0 829 250 discloses a connector assembly mountable to the neck of a vial. The connector assembly comprises a collar mountable to the rim of the vial neck between a first position, wherein the collar is removably secured to the rim of the vial neck, and a second position, wherein the collar is fixedly secured to the rim of the vial neck. A protective cap of the connector assembly is mountable about the sidewall portion of the collar. A ring is provided adjacent the open proximal end of the cap and is connected thereto by a user-severable connection. The cap has a removable position and an engagement position. In the removable position, the collar is in said first position and the cap is mountable to the collar. When the cap is in its engagement position, the cap is urged in a proximal direction in order to secure the collar in said second position.

EP-A-0 904 763 discloses a connector assembly for a vial. The connector assembly comprises a protective cap having an open proximal end, and a collar provided adjacent the open proximal end of the protective cap. Furthermore, a locking ring is provided between the collar and the rim of the vial. A cooperative locking structure is provided between the collar and the locking ring to retain the locking ring in a locked position respective of the collar.

The object of the present invention is to provide an improved transfer device for fluid communication between a first site and a second site.

A further object of the present invention is to provide an improved method for transferring fluid from a first site to a second site.

It is a further object of the present invention to provide an improved cap assembly for use with a container and a transfer device.

It is a further object to provide an improved method of mounting the improved cap assembly to a container.

According to a first aspect of the present invention, a transfer device for fluid communication between a first site and a second site is provided. The transfer device comprises:

a) a housing having a first end being connectable to the first site, a second end being connectable to the second site and a longitudinal portion between the first and second ends defining a longitudinal axis, the housing including two oppositely arranged wings comprising engaging means for engagement with the first site;

b) a fluid channel provided in the housing for fluid communication between the first end and the second end of the housing; and c) a sleeve assembly mounted to the housing, the sleeve assembly being axially movable relative to and biased against the housing;

wherein the fluid channel comprises at least one needle extending from the housing along the longitudinal axis, the needle being completely accommodated in the sleeve assembly, when the device is non-actuated, and the needle protruding from the sleeve assembly, when the device is axially compressed against the biasing force so as to move the sleeve assembly relative to the housing.

In a preferred form of the transfer device, the sleeve assembly comprises an inner sleeve and an outer sleeve defining a space between them, the biasing force being provided by a compression spring that is partially accommodated in the space between the inner and outer sleeves. More preferably, the sleeve assembly comprises a membrane blocking access to the interior of the sleeve assembly in which the at least one needle is provided. In a further preferred form of the transfer device the sleeve assembly and the housing comprise complementary guiding means for guiding the axial movement of the sleeve assembly relative to the housing. Preferably, the guiding means comprise at least one longitudinal slot provided in the housing and a retention tab provided on the sleeve assembly, the retention tab having a radially protruding portion extending into the slot. In a preferred embodiment, the transfer device further comprises a ventilation duct provided in the housing for allowing air to enter the first site. Preferably, the fluid channel and the ventilation duct are arranged substantially in parallel with respect to one another. More preferably, the fluid channel and the ventilation duct are arranged co-axially at least along a part of their length. Preferably, each of the fluid channel and the ventilation duct comprise a hollow needle. According to a preferred embodiment, the ventilation duct comprises a filter element that is provided in an inlet opening of the ventilation duct.

According to a second aspect of the present invention, a transfer device for fluid communication between a first site and a second site comprises:

a) a housing having a first end being connectable to the first site, a second end being connectable to the second site and a longitudinal portion between the first and second ends defining a longitudinal axis, the housing including two oppositely arranged wings comprising engaging means for engagement with the first site;
b) a fluid channel provided in the housing for fluid communication between the first end and the second end of the housing; and
c) a ventilation duct provided in the housing for allowing air to enter the site from which fluid is transferred;

wherein the fluid channel and the ventilation duct are arranged substantially in parallel with respect to one another. In a preferred form of the transfer device the fluid channel and the ventilation duct are arranged co-axially at least along a part of their length. Preferably, each of the fluid channel and the ventilation duct comprise a hollow needle. More preferably, the ventilation duct comprises a filter element that is provided in an inlet opening of the ventilation duct.

According to a third aspect of the present invention, a transfer device for fluid communication between a first site and a second site comprises:

a) a housing having a first end being connectable to the first site, a second end being connectable to the second site and a longitudinal portion between the first and second ends defining a longitudinal axis, the housing including two oppositely arranged wings comprising engaging means for engagement with the first site; and
b) a fluid channel provided in the housing for fluid communication between the first end and the second end of the housing;

wherein each of the wings is pivotally hinged to the housing and comprises a bridge section and a wing section, the bridge section having two opposing ends and an intermediate part, and the wing section being connected to the bridge section and having a substantially curved shape so that end portions of the wings are further spaced from the housing than a center portion located between the end portions. Preferably, the hinge resiliently biases the wing in a potential engaging position. In a preferred form, the bridge section is hinged to the housing at one of its ends and comprises on its other end a claw being engagable with the engaging means provided on the first and/or second site. Preferably, the curved wing section is connected to the intermediate part of the bridge section. The curved wing section preferably comprises a first curved portion being connected to the bridge section and a second curved portion extending from the first curved portion and forming a finger grip region for actuating the wing.

According to a fourth aspect of the present invention, a transfer device for fluid communication between a first site and a second site, comprises:

a) a housing having a first end being connectable to the first site, a second end being connectable to the second site and a longitudinal portion between the first and second ends defining a longitudinal axis, the housing including two oppositely arranged wings comprising engaging means for engagement with the first site;
b) a fluid channel provided in the housing for fluid communication between the first end and the second end of the housing; and
c) a sleeve assembly mounted to the housing, the sleeve assembly being axially movable relative to and biased against the housing;

wherein each of the wings is pivotally hinged to the housing, and the engagement means being engaged with the sleeve assembly in a non-actuated position such that the sleeve is axially secured relative to the housing. Preferably, the engagement means is formed as a claw. The sleeve assembly preferably comprises a recess into which the claw of the wing engages. Preferably, the sleeve assembly comprises a ramp adjacent the recess, the ramp rising to the recess allowing a smooth travel of the claw up to the recess, when the device is brought from an actuated position into the non-actuated position.

According to a fifth aspect of the present invention, a transfer device for fluid communication between a first site and a second site, the device comprises:

a) a housing having a first end being connectable to the first site, a second end being connectable to the second site and a longitudinal portion between the first and second ends defining a longitudinal axis, the housing including two oppositely arranged wings comprising engaging means for engagement with the first site;
b) a fluid channel provided in the housing for fluid communication between the first end and the second end of the housing; and
c) a sleeve assembly mounted to the housing, the sleeve assembly comprising two oppositely arranged open ended slots extending along the longitudinal axis and each having at least one protrusion;

wherein each of the slots is adapted to receive a mating portion of one of the sites from or into which fluid is to be communicated, wherein the protrusion formed in each of the slots secures the mating portion into place. The protrusion is preferably a circumferentially extending protrusion which narrows the width of the slot.

In all aspects of the present invention the first site is preferably a container, particularly a vial, from or into which fluid is to be transferred.

In a preferred form of all aspects of the invention, the second site is a suction operated dispenser device with which fluid is sucked out of the first site, through the transfer device and into the dispenser device and/or fluid is dispensed through the transfer device into the first site. Preferably, the suction operated dispenser device is a syringe.

In all aspects of the invention, the transfer device preferably further comprises luer connector for connection to at least one of the sites. Preferably, the luer connector comprises a luer lid, a luer plunger and a spring being supported by the housing and forcing the luer plunger against the luer lid so as to close the luer connector.

In all aspects of the invention, the first site preferably comprises a collar formed on the first site or a cap assembly mounted to the first site with which the wings are engagable.

According to a sixth aspect of the invention, the transfer device is a combination of any of the transfer devices of any of the previous aspects and preferred forms.

A seventh aspect of the invention relates to a method for transferring fluid from a first site to a second site using the transfer device of any of the previous six aspects of the invention.

According to an eighth aspect of the invention, a cap assembly for use with a container and a transfer device comprises:

a) a sleeve having an inner surface provided with at least two axially spaced and radially inwardly extending protrusions that are adapted to receive a radially outwardly extending collar of the container therebetween so as to secure the cap assembly at the container, and an outer surface provided with at least two axially spaced annular grooves and at least one recess; and b) a cap having a locking ring and a removable cap portion, the locking ring comprising at least one inwardly extending protrusion being adapted to mate with the annular grooves provided on the outer surface of the sleeve.

Preferably, the locking ring and the removable cap portion are interconnected by a line of weakness that is adapted to break upon removal of the cap portion. Furthermore, it is preferred to provide the sleeve not as a continuously extending ring along its axial length but rather with legs that are adapted to snap over the collar of the container. More preferably, the load to displace the legs of the sleeve is less than the load required for pushing the cap down.

In a preferred form, the locking ring removably holds the cap portion by a thread. More preferably, the locking ring is elastically deformable so that the inwardly extending protrusion of the cap snaps into one of the grooves. The recess provided on the outer surface of the sleeve is preferably formed as an annular groove. Preferably, the recess provided on the outer surface of the sleeve is adapted to mate with an engaging means provided at the transfer device. One of the two axially spaced annular grooves is preferably located adjacent a lower end of the sleeve and the at least one recess is located adjacent an upper end of the sleeve, while the other groove is positioned relatively close to the at least one recess.

In a preferred form, the sleeve comprises a stop member forming an abutment for the locking ring.

According to yet another aspect of the present invention, a method of mounting the cap assembly to a container comprises the steps of:

a) pushing the cap assembly onto a collar of a neck provided on the container so that the collar is accommodated between the two inwardly extending annular protrusions of the sleeve, while the cap is in a mounting position in which the inwardly extending protrusion of the locking ring is engaged with an upper one of the two grooves formed on sleeve; and b) pushing the cap from the mounting position into a locking position in which the cap assembly is secured to the container, wherein in the locking position the inwardly extending protrusion of the locking ring is engaged with a lower one of the two grooves formed in the sleeve.

Preferably, the method comprises the additional step of:

c) removing the cap portion of the cap assembly from the locking portion so as to expose the at least one recess for engagement with engaging means of a transfer device.

In the following, preferred embodiments of the transfer device and the cap assembly of the present invention will be described with references to the drawings, in which.

The components of the transfer device 2 of the present invention will be described in the following with reference to FIGS. 1 to 3. The transfer device 2 is generally adapted for fluid communication between a first site, e.g., a bottle, container or vial, and a second site, e.g. a suction operated dispenser device such as a syringe. More precisely, the transfer device 2 of the present invention can be advantageously used for the transfer of fluid (i.e. gas or liquid) from a container into a syringe whereby fluid is sucked out of the container through the transfer device 2 and into the syringe. Similarly, the device can be used for the transfer of fluid from the syringe, through the transfer device 2 into the same or a different container, for example an infusion bag, representing the first site.

Figure 1:
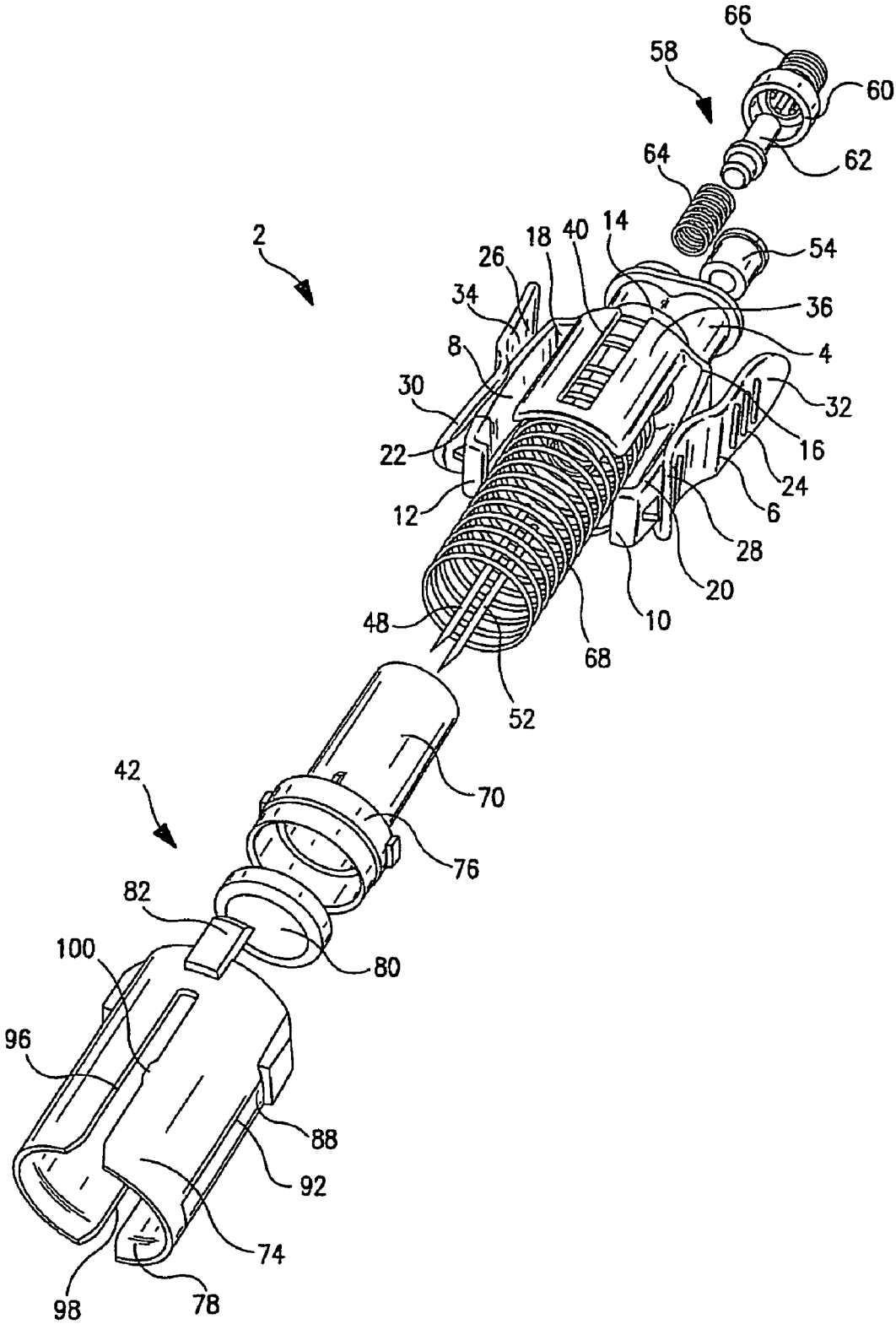
FIG. 1 is an exploded isometric view of a preferred embodiment of the transfer device of the present invention.
Figure 2A:
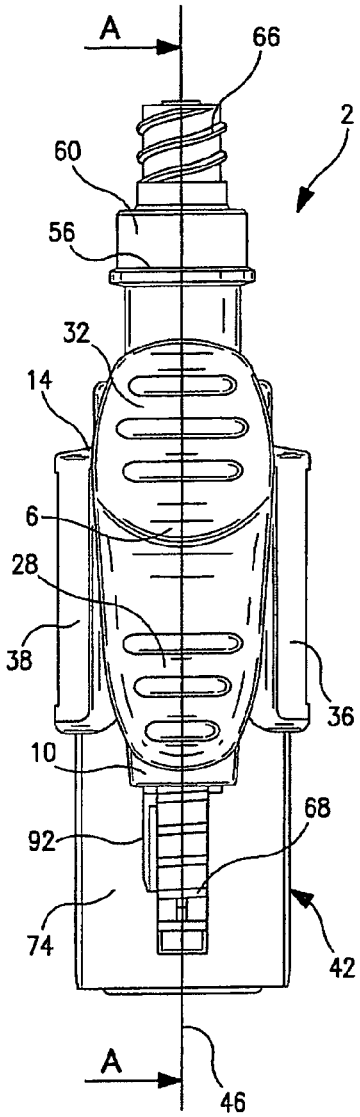
FIG. 2A is a side view of the transfer device of FIG. 1.

The transfer device 2 shown in FIG. 1 comprises a housing 4 which is preferably made of plastic material. The housing 4 has two oppositely arranged wings 6 and 8, each comprising engaging means 10 and 12 for engagement with the first site, e.g. a collar of a container, vial or cap assembly. Preferably, the engaging means 10 and 12 are formed as claws which can be engaged with the collar of a container. Each of the wings 6 and 8 is typically pivotally hinged to a main portion 14 of the housing 4. This is preferably accomplished by an appropriate selection of the material in combination with the construction of the wings 6 and 8 in the respective hinge regions 16 and 18. For example, the material of the wings 6 and 8 may be an elastic plastic material so that the wings can be bent around the hinge portions 16 and 18 in order to engage and disengage the claws 10 and 12. In order to effectively accomplish the engagement and disengagement function of the wings 6 and 8, each of the wings preferably comprises a bridge section 20 and 22 and a wing section 24 and 26. Each of the bridge sections 20 and 22 has two opposing ends, namely the hinge portions 16, 18 and the engaging means or claws 10, 12. The ends of the bridge sections 20 and 22 are interconnected by respective intermediate parts. Each of the wing sections 24 and 26 is connected to the respective bridge sections 20 and 22, preferably at the intermediate part thereof. Furthermore, the wing sections 24 and 26 have preferably a substantially curved shape that can best be seen in FIGS. 2B and 3A. As shown in these figures, each of the curved wing sections 24 and 26 may comprise a first curved portion 28, 30 connected to the intermediate part of the bridge sections 20, 22 and a second curved portion 32, 34 extending from the first curved portions 28, 30 and forming a finger grip region for actuating the wings 6, 8. The first curved portion 28, 30 is adapted for being gripped by the fingers of a user in order to force the claws 10, 12 in their engaged position. This provides an additional safety feature when the transfer device 2 is mounted to a container, vial or cap assembly because the user can thus actively assist the engagement between the transfer device 2 and, e.g., the container, while holding the arrangement.

However, instead of this curved construction of the wing sections 24, 26, any construction may be used in connection with the present invention as long as the end portions of the wing sections adjacent to the hinge portions 16 and 18 are further spaced from the housing 4 than the opposite ends of the wings 6 and 8. This construction is considered particularly advantageous since the engaging means 10 and 12 of the wings 6 and 8 can be opened further than in known devices in which the finger grip regions of the wings are arranged equidistantly from the body of the transfer device (see, e.g., EP 0 544 654 B1).

The housing 4 of the transfer device 2 of present invention furthermore comprises two oppositely arranged housing portions 36 and 38, only one of which can be seen in FIG. 1. These housing portions 36 and 38 are preferably arranged circumferentially inbetween the wings 6 and 8. Housing portions 36 and 38 are mounted to the main portion 14 of the housing 4 and are preferably integral therewith. Each of the housing portions 36 and 38 comprises a longitudinal slot 40 forming the first part of complementary guiding means for guiding an axial movement of a sleeve assembly 42 relative to the housing 4.

Figure 2B:
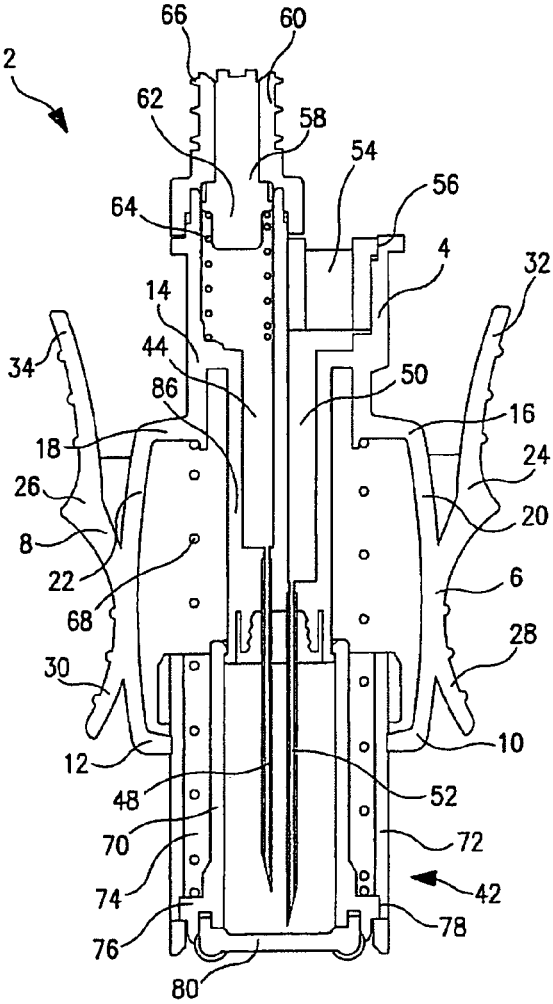
FIG. 2B is a cross-sectional view along line A—A of FIG. 2A.

As can thus be seen in FIG. 2B, the transfer device of the present invention comprises a fluid channel 44 provided in and extending through the housing 4 for fluid communication between the first site and the second site. More precisely, this fluid channel 44 extends substantially along a longitudinal axis 46 of the device through the housing 4. The fluid channel 44 preferably comprises at least one needle 48, forming an extension of the channel, wherein the needle 48 extends from the housing 4 substantially parallel to the longitudinal axis thereof. The needle 48 is hollow and has a tip portion that, upon engagement of the transfer device 2 of the present invention with a fluid container, extends at least partially into the fluid so that the fluid can be transferred through the hollow needle 48 and the fluid channel 44 provided in the housing 4 to the second site (e.g. a syringe).

Furthermore, the housing 4 preferably comprises a ventilation duct 50 for allowing air to enter into the first site (e.g. the container) from which fluid is removed. Similarly, as in case of the fluid channel 44, the ventilation duct 50 preferably comprises a needle 52 that extends from the housing in a substantially longitudinal direction. The fluid channel 44 and the ventilation duct 50 are arranged substantially parallel with respect to one another, as can best be seen in FIG. 2B. In particular, the needles 48 and 52 are arranged substantially parallel with respect to one another and can in fact be arranged co-axially. The ventilation duct 50 may comprise a filter element 54 being mounted in an inlet opening 56 provided in the housing 4 of the transfer device 2. This inlet opening 56 is preferably also arranged parallel to the fluid channel 44 and the ventilation duct 50.

The transfer device 2 of the present invention furthermore preferably comprises a luer connector 58 for connecting the device to the second site, in particular to a suction operated dispenser device like a syringe. The luer connector 58 comprises a luer lid 60, a luer plunger 62 and a spring 64. The spring is a compression spring supported on its one end by the housing 4 and acting with its other end on the luer plunger so as to force the luer plunger 62 against the luer lid 60 in order to close the luer connector 58. Preferably, the luer lid 60 comprises on its outer circumference a thread 66 to which the second site can be connected.

As already briefly mentioned above, the sleeve assembly 42 is axially moveable relative to the housing 4. Additionally, the sleeve assembly 42 is biased against the housing 4 by means of a compression spring 68. The compression spring is supported with one of its ends by the housing 4 while the other end acts on the sleeve assembly 42 so as to force the sleeve assembly in a non-actuated or extended position, respectively. From this non-actuated position the sleeve assembly may be pushed against the force of the compression spring 68 so as to move relative to the housing 4 in an actuated position. In the non-actuated position the needles 48 and 52 extending from the housing 4 are completely accommodated within the sleeve assembly 42 as can be clearly seen in FIG. 2B. This provides a safety feature because the user cannot accidentally be contacted by the needles. Accordingly, in the non-actuated position the entire fluid channel 44 and the ventilation duct 50 and particularly the needles 48 and 52 are not accessible from the outside and are therefore kept clean. If the transfer device 2 is to be kept sterile, it is typically sterilely held in a packaging.

The sleeve assembly 42 advantageously comprises an inner sleeve 70 and an outer sleeve 72 defining a space 74 inbetween. The compression spring 68 acting on the sleeve assembly 42 is at least partially accommodated within the space 74 provided between the inner and outer sleeves 70 and 72. The outer sleeve 72 is mounted to the inner sleeve by means of a rim 76 provided on the inner sleeve and extending into a recess or slot 78 formed in the outer sleeve 72. Furthermore, the sleeve assembly 42 advantageously comprises a membrane 80 blocking access to the interior of the sleeve assembly. This provides an additional safety feature. The axial movement of the sleeve assembly relative to the housing 4 is preferably guided by complementary guiding means already referred to above. One of the guide elements of the complementary guiding means is the slot 40 provided in each of the housing portions 36 and 38. The second part of this complementary guiding means is formed by two oppositely arranged retention tabs 82 and 84 that protrude from the outer circumference of the outer sleeve 74 of the sleeve assembly 42 and extend into the longitudinal slots 40 of the housing members 36 and 38. This can best be seen in FIGS. 3A and 3B. With these retention tabs 82 and 84 the sleeve assembly is securely mounted to the housing 4 and axially moveable relative to it. In addition to the complementary guiding means, the sleeve assembly 42 is preferably additionally guided along the inner circumferential face of the inner sleeve 70. More precisely, the housing 4 may comprise an inner housing portion 86 in which on the one hand the fluid channel 44 and the ventilation duct 50 are provided, and on which the inner sleeve 70 of the sleeve assembly 42 slides. This configuration can best be seen in FIGS. 2B and 3B. Advantageously the sleeve 70 and/or the inner housing portion 86 comprise one or more radial protrusions that form an abutment for the maximum extension of the sleeve assembly 42 relative to the housing 4.

Figure 6:
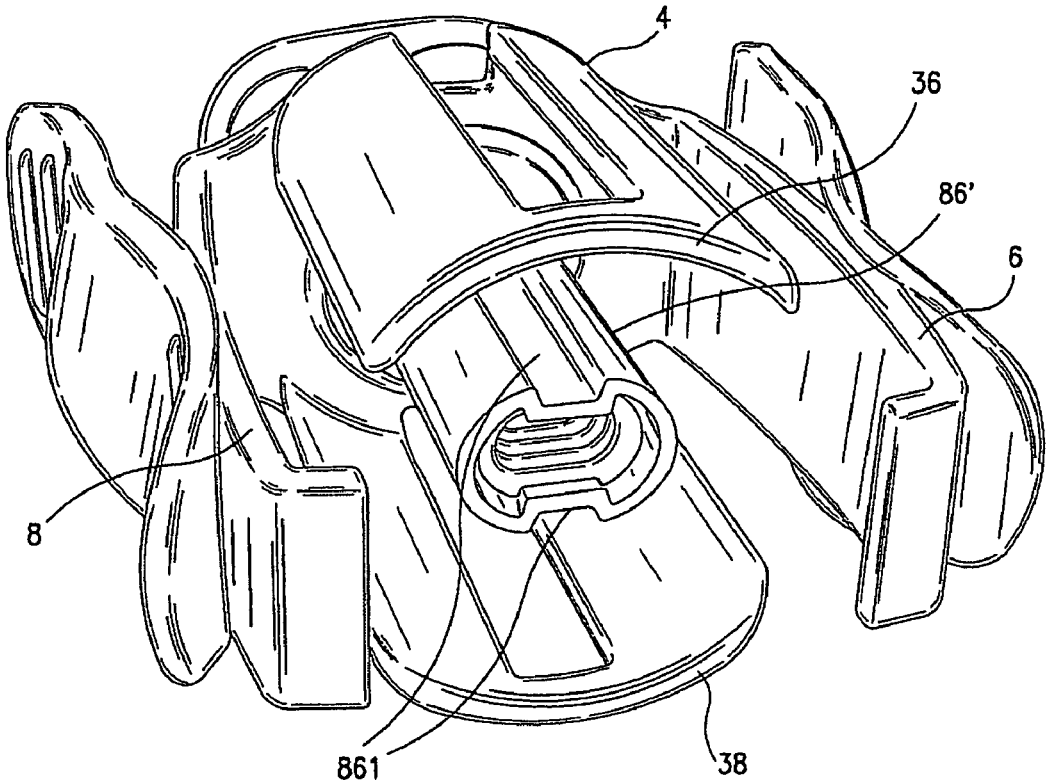
FIG. 6 is an isometric view of a preferred embodiment of the housing of the transfer device.
Figure 7A:
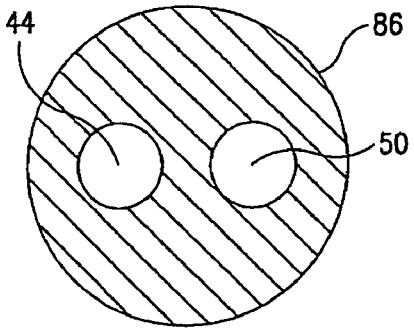
FIGS. 7A, 7B are cross-sectional views of two profiles of the inner housing portion of the housing of the transfer device.
Figure 7B:
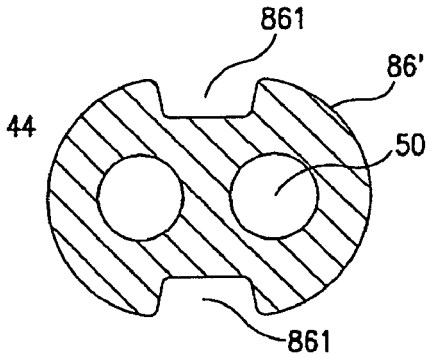
Figure 8A:
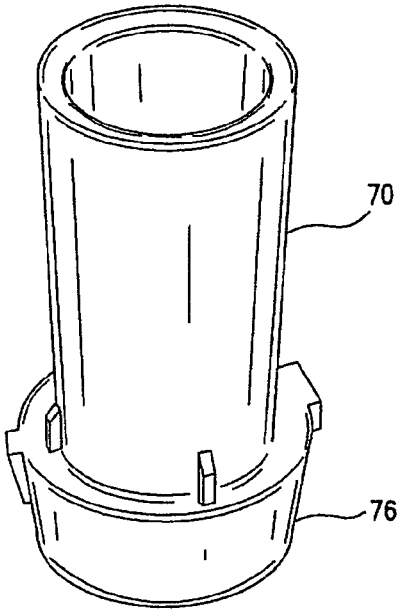
FIGS. 8A, 8B are isometric views of the inner sleeve of the transfer device.
Figure 8B:
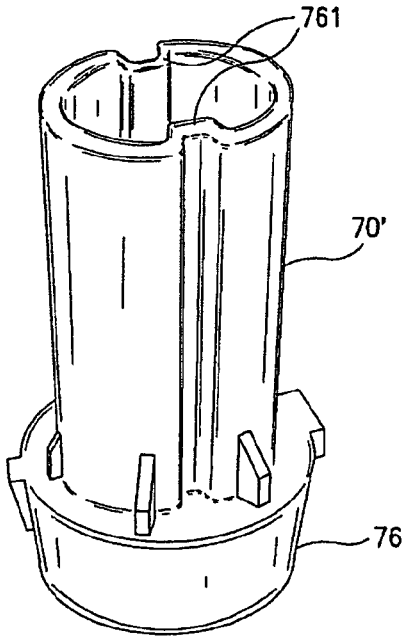

As shown in FIGS. 2B and 7A, the inner housing portion 86 of the housing 4 has a substantially circular configuration. In particular FIG. 7A shows the circular cross-section of the inner housing portion 86 with its two channels, i.e., the fluid channel 44 and the ventilation duct 50. FIGS. 6 and 7B show an alternative design of the inner housing portion 86'. In this preferred form, the inner housing portion 86' comprises two opposite areas 861 of reduced wall section. The inner housing portion 86' is thus more H-shaped than circular. As shown in the drawings, the areas of reduced wall section have essentially the form of longitudinal grooves extending along the axis of the inner housing portion 86'. This particular design of the inner housing portion 86' is advantageous in that is contributes to reduce the cycle-time during manufacturing of the transfer device (the cycle-time is the time taken for the tool to close, the injection of the plastic, the cooling of the part and finally the ejection of the part from the tool). FIGS. 8A and 8B show the two designs of the inner sleeve 70, 70' being adapted to the specific profile of the inner housing portion 86, 86'. FIG. 8A shows the essentially cylindrical inner sleeve 70 being adapted to the cylindrical profile of the inner housing portion 86. FIG. 8B shows the modified design of the inner sleeve 70' having substantially longitudinal grooves in the outer surface of the sleeve and extending along the longitudinal axis of the sleeve. The grooves have a sufficient depth so that the inner cylindrical surface of the sleeve comprises longitudinal webs 761 that fit the profile of the modified inner housing portion 86'.

Figure 3A:
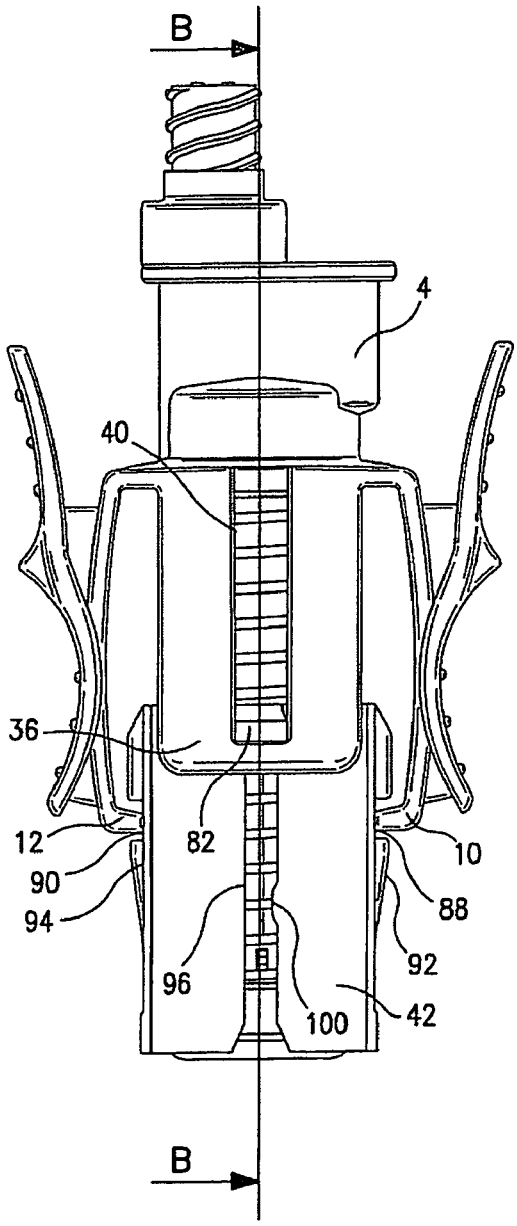
FIG. 3A is a front view of the transfer device of FIG. 1.
Figure 3B:
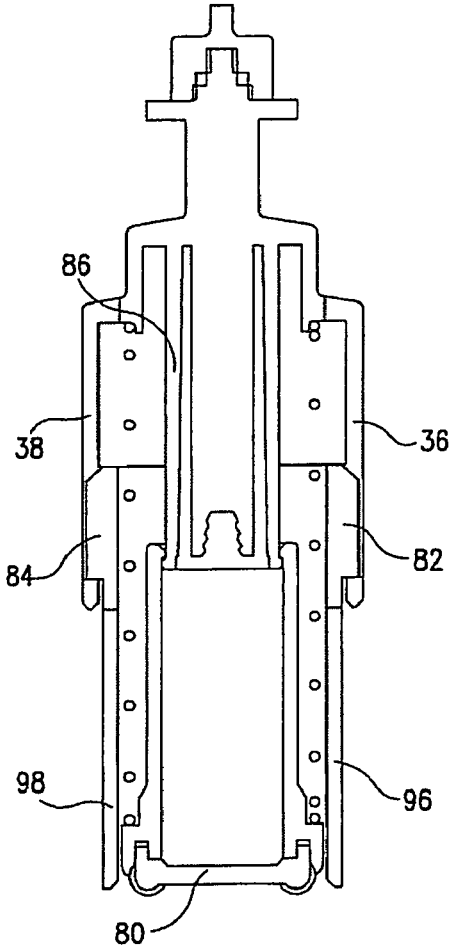
FIG. 3B is a cross-sectional view along B—B of FIG. 3A.

Furthermore, it is particularly advantageous that the engagement means or claws 10 and 12 of the wings 6 and 8 are resiliently biased into a potential engaging position by means of the hinge portions 16 and 18 so that without activating the wings the transfer device 2 of the present invention is always kept in its engaged position. Besides the fact that with this construction the device is always safely kept on the first site, this has the advantage that the claws 10 and 12 of the wings 6 and 8 may effectively block the axial movement of the sleeve assembly relative to the housing 4. To this end the sleeve assembly 42 may be provided with one or more recesses which are preferably two oppositely arranged recesses 88, 90 into which the claws 10 and 12 of the wings engage in the non-actuated position of the transfer device 2. This is best illustrated in FIG. 3A. This engagement of the claws in the recesses in the non-actuated position of the transfer device 2 provides a further safety feature for protecting the user and the needles. Accordingly, in order to bring the transfer device 2 of the present invention to its actuated position the finger grip region 32 and 34 of the wings 6 and 8 have to be pressed together so as to pivot the claws 10 and 12 out of the recesses 88 and 90, whereby the sleeve assembly 42 will be axially moveable relative to the housing 4. It may also be advantageous to provide ramps 92 and 94 adjacent to the recesses 88 and 90 allowing a smooth travel of the claws 10 and 12 into the recesses 88 and 90 when the device is brought from an actuated position into the non-actuated position.

Additionally, it may be advantageous for certain applications of the transfer device of the present invention to provide the sleeve assembly 42 with two oppositely arranged open-ended slots 96 and 98 extending parallel to the longitudinal axis 46 of the transfer device 2. Along the length of each of the open-ended slots 96 and 98 at least one protrusion 100 is provided that preferably extends in a circumferential direction so as to narrow the width of the slots 96, 98. The slots 96 and 98 in combination with their protrusion are adapted to receive a mating portion of the first site from or into which fluid is to be communicated, wherein the protrusion 100 formed in each of the slots 96, 98 secures the mating portion into place. More precisely, the mating portion of the first site may comprise two oppositely extending tabs formed on a substantially cylindrical neck of a container, e.g., an infusion bag, wherein each of the tabs extends in a corresponding one of the slots 96 and 98 so as to be securely held on the transfer device 2 of the present invention by the protrusions 100. Preferably, the distance between the end of the slot 96, 98 and the protrusion 100 corresponds to the height of the tabs on the container neck. Furthermore, the width of the slot 96, 98 preferably corresponds to the width of the tabs. Other infusion bags without such a mating portion are typically held in the sleeve assembly 42 by friction. With such infusion bags (first site) slots 96, 98 are not necessary, although they would not be of any disadvantage.

In the following, a cap assembly 102, which can advantageously be used in combination with the transfer device 2 of the present invention, will be described with reference to FIGS. 4 and 5. The cap assembly 102 essentially comprises a sleeve 104 that is adapted to be mounted on a container 106. The sleeve 104 has an inner surface that is provided with a first radially inwardly extending protrusion 108 and at least a second radially inwardly extending protrusion 110. The protrusions 108 and 110 are preferably formed as annular protrusions. These two protrusions 108 and 110 are adapted to receive a radially outwardly extending collar 112 of the container 106 in between so as to secure the cap assembly 102 at the container 106. The axial distance between the first and second protrusions 108 and 110 corresponds substantially to the height of the collar 112 so that the cap assembly 102 is relatively fixedly mounted on the container 106.

Although not shown in the drawings the sleeve 104 is advantageously made of a ring portion and a plurality of axially extending legs the are adapted to snap over the collar 112 of the container 106. More precisely, the legs are constructed such that the load necessary to displace the legs radially is less than the force required to push a cap 114 of the cap assembly 102 down onto the sleeve.

Figures 4A, 4B, 4C, 4D, 4E:
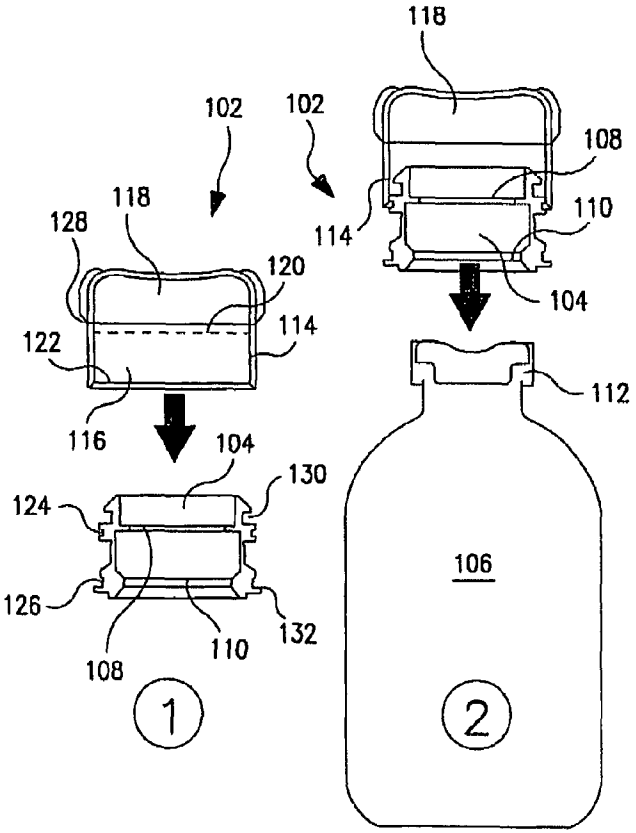
FIGS. 4A to 4E are cross-sectional views of a preferred embodiment of the cap assembly of the present invention illustrating how the cap assembly is assembled onto a vial.

The cap 114 has a locking ring 116 and a removable cap portion 118. The locking ring 116 comprises at least one inwardly extending protrusion 122 (FIG. 4A). However, in some instances it may be preferred to provide a second inwardly extending protrusion that is axially spaced from the first protrusion 122. This second protrusion is shown in FIG. 4A in form of the dashed line with the reference sign 120. Furthermore, the sleeve 104 is provided on its outer surface with at least two recesses, preferably annular grooves 124 and 126, that are adapted to mate with the inwardly extending protrusion 122 of the locking ring 116. The annular grooves 124 and 126 are best shown in FIG. 4A in which the cap assembly 102 is illustrated in the pre-assembled condition.

The locking ring 116 and the removable cap portion 118 of the cap 114 are preferably interconnected by a line of weakness 128 which is adapted to break upon removal of the cap portion 118 from the locking ring 116. Typically, the locking ring 116 is elastically deformable so that the inwardly extending protrusion 122 of the cap 114 can snap into the grooves 124 and 126 of the sleeve 104. Similarly, the sleeve 104 itself may be elastically deformable so that it can be pushed over the collar 112 of the container 112. This is advantageously achieved by means of the legs of the sleeve 104 (not shown).

The sleeve 104 of the cap assembly 102 furthermore comprises at least one recess, preferably a third annular groove 130, that is provided on the outer surface of the sleeve 104. More precisely, the at least one recess or the preferred third annular groove 130 is located adjacent to an upper end of the sleeve 104 and adjacent to the first annular groove 124, while the second annular groove 126 is axially spaced from it and provided at a lower end of the sleeve 104.

The sleeve 104 preferably comprises a stop member 132 forming an abutment for the locking ring 116 when it is assembled to the sleeve 104.

With reference to FIGS. 4A to 4E, it will be described in the following how the cap assembly 102 can be mounted to the container 104. If the cap portion 114 of the cap assembly 102 is not initially mounted to the sleeve 104, a pre-assembling step may be required as shown in FIG. 4A. More precisely, the cap portion 114 is mounted to the sleeve 104 by co-axially pushing it onto the sleeve until the protrusion 122 snaps into the first, upper annular groove 124. This condition of the collar sub-assembly or cap assembly 102 is shown in FIG. 4B. Next, the cap assembly 102 is located over the container (e.g. vial) 106 and pushed onto the collar 112 of-the neck of the vial so that the collar 112 is accommodated between the two inwardly extending annular protrusions 108 and 110 of the sleeve 104. This is shown in FIG. 4C. In this condition the cap assembly 110 can be removed again from the container 106, if necessary, e.g., in order to fill the container 106. As a next step, the cap assembly 102 is pushed from the mounting position shown in FIG. 4C into a locking position illustrated in FIG. 4D. In this locking position the cap assembly is secured to the container 106, wherein the inwardly extending protrusion 122 of the locking ring 116 is engaged with the second, lower annular groove 126 formed on the outer surface of the sleeve 104. In this condition, the cap assembly is unremovably mounted to the container 106 since the locking ring 114 blocks any radially outwardly directed movement of the sleeve 104 that would occur if the cap assembly was tried to be pulled from the container 106. In order to get access to the interior of the container 106 the removable cap portion 118 has to be removed from the locking ring 116, e.g. by breaking the line of weakness 128 provided between these portions. Upon removal of the cap portion 118 the at least one recess or the preferred third annular groove 130 is exposed for engagement with the claws 10 and 12 of the transfer device 2 of the present invention. This is shown in FIG. 4E where the container 106 with the mounted cap assembly 102 is ready for use with the transfer device 2 in order to transfer fluid from the container 106 to a second site, e.g. a syringe.

Figure 5C:
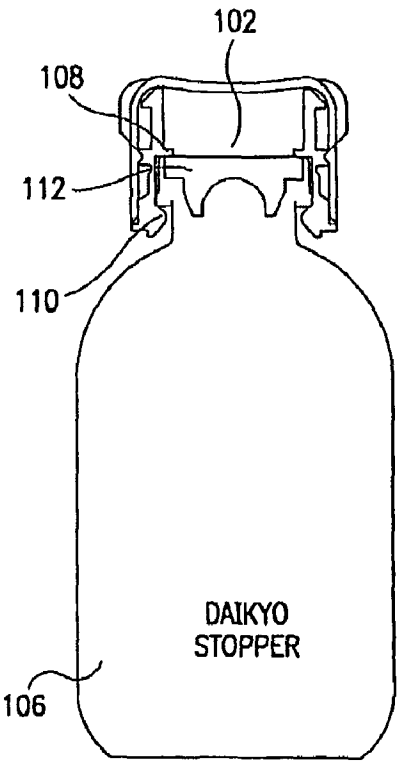
FIGS. 5A to 5C show an embodiment of the cap assembly of the present invention assembled to vials of different sizes.
Figure 5B:
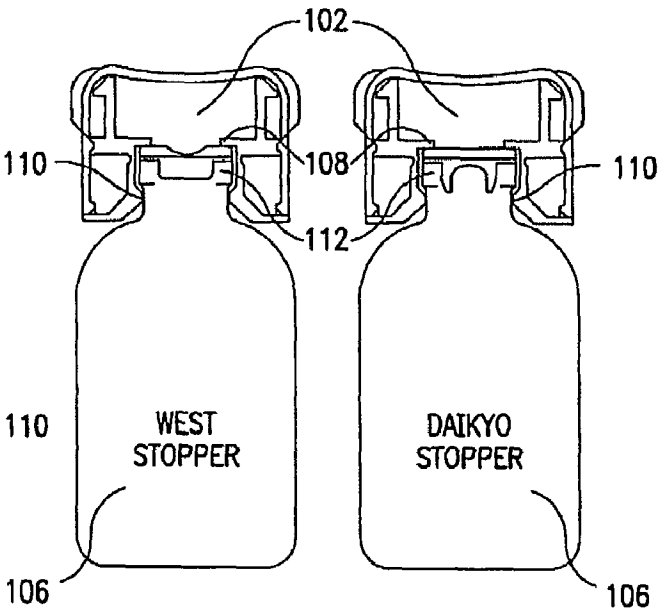
Figure 5A:
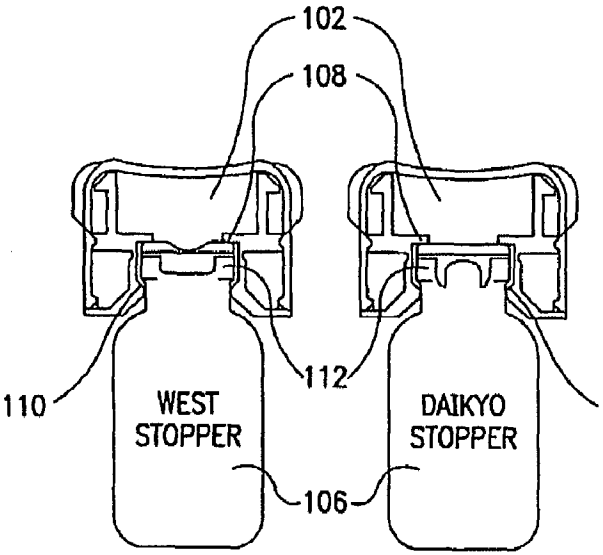

In FIGS. 5A to 5C containers or vials 106 of different sizes are shown, on each of which the cap assembly 102 of the present invention has been mounted. As can be seen upon a comparison of the cap assemblies 102 shown in these figures, the outer dimensions of the cap assemblies 102 are substantially identical, independent of the size of the collar 112 of the vials 106. More precisely, the cap assemblies 102 of the present invention are adapted to differently sized collars 112 in that the two axially spaced and radially inwardly extending protrusions 108 and 110 of the sleeve 104 are positioned more inwardly in case of collars 112 having a smaller diameter, as shown in FIGS. 5A and 5B, and more outwardly in case of a collar 112 having a larger diameter, as shown in FIG. 5C. Accordingly, for all these cap assemblies 102 shown in FIG. 5A to 5C a transfer device 2 of the same size can be used, although the containers 106 and their collars 112 are of different sizes.

Finally, it will be described how fluid can be communicated between a first site and second site by use of the transfer device 2 and the collar assembly 102 of the present invention. As already described above with reference to FIG. 4A to 4E the transfer device 2 of the present invention is preferably used in combination with the cap assembly 102 of the present invention mounted to the container 106 representing a first site, from which or into which fluid is to be communicated. Nevertheless, the transfer device of the present invention may be used without the cap assembly 2 so that the engaging means 10 and 12 engage directly with the collar 112 formed on the neck of a container 106. In this instance it may, however, be necessary to prolong the wings and particularly the engaging means 10 and 12.

Consequently, while in the following the function of the transfer device 2 will be described with reference to the cap assembly 102 it should be readily understandable by the person skilled in the art that the same function of the transfer device 2 is also possible without the cap assembly 102.

In order to transfer fluid, particularly a liquid (e.g. medicines), from a first site like the container or vial 106 shown in FIGS. 4 and 5, the sleeve assembly 42 is initially brought into contact with the upper end portion of the sleeve 104 of the cap assembly 102. Then, the wings 6 and 8 of the transfer device 2 are actuated by pressing the finger grip regions 32 and 34 so that the claws 10 and 12 remove from the recesses 88 and 90 and the sleeve assembly 42 is released from its fixed position. Subsequently, the transfer device 2 is pushed against the vial 106 so that the sleeve assembly 42 moves axially into the housing 4 against the force of the compression spring 60. While the sleeve assembly 42 slides into the housing 4, the needle 52 of the ventilation duct 50 and the needle 48 of the fluid channel 44 penetrate through the membrane 80 and extend into the vial 106 so as to be immersed in the liquid provided therein. In this condition, the wings 6 and 8 can be released, wherein, due to the resiliency of the material and the construction of the hinge portions 16 and 18, the wings return to their non-actuated position in which the claws 10 and 12 engage with the annular groove 130 provided on the cap assembly 102 or directly with the collar 112 of the container 106.

Subsequently or even prior to the mounting of the transfer device 2 to the vial 106, a second site, particularly a suction operated dispenser device (e.g. a syringe), is mounted to the luer connector 58 provided at the end portion of the housing 4 opposite to the vial 106. Upon mounting the syringe to the luer connector 58 the luer plunger 62 is forced from its closing position to an open position against the force of the spring 64 so as to open the fluid channel 44 from the vial 106 to the syringe. In this condition fluid can be exchanged between the first site and the second site through the fluid channel 44, whereas, if necessary, air can enter or escape through the ventilation duct 50.

More precisely, when the transfer device 2 of the present invention is mounted to the first and second sites, in a first step the fluid is sucked out of the vial 106 (first site), through the fluid channel 44 comprising the needle 48 and into the suction operated dispenser device or syringe (second site). The syringe with the stored liquid from the vial 106 may then be removed from the luer connector 58 of the transfer device 2 of the present invention and used elsewhere. Alternatively, the transfer device 2 of the present invention may be removed from the vial 106 by pressing the finger grip regions 32 and 34 of the wings 6 and 8 together so as to release the transfer device 2 from the vial 106. Then, the transfer device may be mounted to another container, vial, tubing, infusion bag etc. now representing the first site either by mounting the device by means of the claws 10 and 12 to a corresponding groove or recess or by providing a mating portion of the first site into the open-ended slots 96 and 98 until the mating portion is held by the protrusion 100 within these slots. The fluid stored within the suction operated dispenser device or syringe (second site) can then be transferred from there through the fluid channel 44 with its needle 48 into the container, vial, tubing, infusion bag etc. (first site). Once the transfer of the fluid is finished the transfer device 2 of the present invention is typically removed from the first site and the second site, whereas the sleeve assembly moves again to its non-actuated position, i.e. to a position where it covers the needles 48 and 52 so that they are not exposed to the environment.

Accordingly, the transfer device 2 of the present invention represents a useful tool for the transfer of liquids from a first site to a second site and vice versa which is particularly safe and easy to handle. Moreover, the transfer device 2 of the present invention can be used for a plurality of applications and is particularly suited for the transfer of medicines (including but not limited to Paclitaxel, Carboplatin, biological agents, and the like) from a first site to a second site. The use of the transfer device 2 of the present invention is particularly easy in combination with the cap assembly 102 of the present invention that can be mounted to various kinds of containers or vials 106 and allows an easy and safe engagement of the transfer device with the container or vial.

The invention claimed is:

1. A transfer device (2) for fluid communication between a first site and a second site, the transfer device (2) comprising:

a) a housing (4) having a first end being connectable to the first site, a second end being connectable to the second site and a longitudinal portion between the first and second ends defining a longitudinal axis (46), the housing (4) including two oppositely arranged wings (6, 8) comprising engaging means (10, 12) for engagement with the first site;

b) a fluid channel (44) provided in the housing (4) for fluid communication between the first end and the second end of the housing (4); and c) a sleeve assembly (42) mounted to the housing (4), the sleeve assembly (42) being axially movable relative to and biased against the housing (4);

wherein the fluid channel (44) comprises at least one needle (48) extending from the housing (4) along the longitudinal axis (46), the needle (48) being completely accommodated in the sleeve assembly (42), when the transfer device (2) is non-actuated, and the needle (48) protruding from the sleeve assembly (42), when the transfer device (2) is axially compressed against the biasing force so as to move the sleeve assembly (42) relative to the housing (4).

2. The transfer device (2) of claim 1, wherein the sleeve assembly (42) comprises an inner sleeve (70) and an outer sleeve (72) defining a space (74) between them, the biasing force being provided by a compression spring (68) that is partially accommodated in the space (74) between the inner and outer sleeves (70, 72).

3. The transfer device (2) of claim 1, wherein the sleeve assembly (42) comprises a membrane (80) blocking access to the interior of the sleeve assembly (42) in which the at least one needle (48) is provided.

4. The transfer device (2) of claim 1, wherein the sleeve assembly (42) and the housing (4) comprise complementary guiding means (40, 82) for guiding the axial movement of the sleeve assembly (42) relative to the housing (4).

5. The transfer device (2) of claim 4, wherein the guiding means comprise at least one longitudinal slot (40) provided in the housing (4) and a retention tab (82) provided on the sleeve assembly (42), the retention tab (82) having a radially protruding portion extending into the slot (40).

6. The transfer device (2) of claim 1 further comprising a ventilation duct (50) provided in the housing (4) for allowing air to enter the first site.

7. The transfer device (2) of claim 6, wherein the fluid channel (44) and the ventilation duct (50) are arranged substantially in parallel with respect to one another.

8. The transfer device (2) of claim 7, wherein the fluid channel (44) and the ventilation duct (50) are arranged co-axially at least along a part of their length.

9. The transfer device (2) of claim 7, wherein each of the fluid channel (44) and the ventilation duct (50) comprise a hollow needle (48, 52).

10. The transfer device (2) of claim 6, wherein the ventilation duct (50) comprises a filter element (54) that is provided in an inlet opening (56) of the ventilation duct (50).

11. A transfer device (2) for fluid communication between a first site and a second site, the transfer device (2) comprising:

a) a housing (4) having a first end being connectable to the first site, a second end being connectable to the second site and a longitudinal portion between the first and second ends defining a longitudinal axis (46), the housing (4) including two oppositely arranged wings (6, 8) comprising engaging means (10, 12) for engagement with the first site;

b) a fluid channel (44) provided in the housing (4) for fluid communication between the first end and the second end of the housing (4); and c) a ventilation duct (50) provided in the housing (4) for allowing air to enter the site from which fluid is transferred;

wherein the fluid channel (44) and the ventilation duct (50) are arranged substantially in parallel with respect to one another.

12. The transfer device (2) of claim 11, wherein the fluid channel (44) and the ventilation duct (50) are arranged co-axially at least along a part of their length.

13. The transfer device (2) of claim 12, wherein each of the fluid channel (44) and the ventilation duct (50) comprise a hollow needle (48, 52).

14. The transfer device (2) of claim 13, wherein the ventilation duct (50) comprises a filter element (54) that is provided in an inlet opening (56) of the ventilation duct (50).

15. A transfer device (2) for fluid communication between a first site and a second site, the transfer device (2) comprising:

a) a housing (4) having a first end being connectable to the first site, a second end being connectable to the second site and a longitudinal portion between the first and second ends defining a longitudinal axis (46), the housing (4) including two oppositely arranged wings (6, 8) comprising engaging means (10, 12) for engagement with the first site; and b) a fluid channel (44) provided in the housing (4) for fluid communication between the first end and the second end of the housing (4);

wherein each of the wings (6, 8) is pivotally hinged to the housing (4) and comprises a bridge section (20, 22) and a wing section (24, 26), the bridge section (20, 22) having two opposing ends and an intermediate part, and the wing section (24, 26) being connected to the bridge section (20, 22) and having a substantially curved shape so that end portions of the wings (6, 8) are further spaced from the housing (4) than a center portion located between the end portions.

16. The transfer device (2) of claim 15, wherein the hinge (16, 18) resiliently biases the wing (6, 8) in a potential engaging position.

17. The transfer device (2) of claim 16, wherein each of the bridge sections (20, 22) is hinged to the housing (4) at one of its ends and comprises on its other end a claw (10, 12) being engagable with the engaging means provided on the first and/or second site.

18. The transfer device (2) of claim 17, wherein each of the wing sections (24, 26) is connected to the intermediate part of the bridge sections (20, 22).

19. The transfer device (2) of claim 18, wherein each of the wing sections (24, 26) comprises a first curved portion being connected to the bridge sections (20, 22) and a second curved portion extending from the first curved portion and forming a finger grip region (32, 34) for actuating the wings (6, 8).

20. A transfer device (2) for fluid communication between a first site and a second site, the transfer device (2) comprising:

a) a housing (4) having a first end being connectable to the first site, a second end being connectable to the second site and a longitudinal portion between the first and second ends defining a longitudinal axis (46), the housing (4) including two oppositely arranged wings (6, 8) comprising engaging means (10, 12) for engagement with the first site;

b) a fluid channel (44) provided in the housing (4) for fluid communication between the first end and the second end of the housing (4); and c) a sleeve assembly (42) mounted to the housing (4), the sleeve assembly (42) being axially movable relative to and biased against the housing (4);

wherein each of the wings (6, 8) is pivotally hinged to the housing (4), and the engaging means (10, 12) being engaged with the sleeve assembly (42) in a non-actuated position such that the sleeve assembly (42) is axially secured relative to the housing (4).

21. The transfer device (2) of claim 20, wherein each of the engaging means is formed as a claw (10, 12).

22. The transfer device (2) of claim 21, wherein the sleeve assembly (42) comprises a recess (88, 90) into which the engaging means (10, 12) of the wings (6, 8) engages.

23. The transfer device (2) of claim 22, wherein the sleeve assembly (42) comprises a ramp (92, 94) adjacent the recess, the ramp (92, 94) rising to the recess (88, 90) allowing a smooth travel of the engaging means (10, 12) into the recess (88, 90), when the transfer device (2) is brought from an actuated position into the non-actuated position.

24. A transfer device (2) for fluid communication between a first site and a second site, the transfer device (2) comprising:

a) a housing (4) having a first end being connectable to the first site, a second end being connectable to the second site and a longitudinal portion between the first and second ends defining a longitudinal axis (46), the housing (4) including two oppositely arranged wings (6, 8) comprising engaging means (10, 12) for engagement with the first site;

b) a fluid channel (44) provided in the housing (4) for fluid communication between the first end and the second end of the housing (4); and c) a sleeve assembly (42) mounted to the housing (4), the sleeve assembly (42) comprising two oppositely arranged open ended slots (96, 98) extending along the longitudinal axis (46) and each having at least one protrusion (100);

wherein each of the slots (96, 98) is adapted to receive a mating portion of one of the sites from or into which fluid is to be communicated, wherein the protrusion (100) formed in each of the slots (96, 98) secures the mating portion into place.

25. The transfer device (2) of claim 24, wherein the protrusion (100) is a circumferentially extending protrusion which narrows the width of the slot (96, 98).

26. The transfer device (2) of claim 1, wherein the first site is a container (106), particularly a vial, from or into which fluid is to be transferred.

27. The transfer device (2) of claim 26, wherein the second site is a suction operated dispenser device with which fluid is sucked out of the first site, through the transfer device (2) an into the dispenser device and/or fluid is dispensed through the transfer device (2) into the first site.

28. The transfer device (2) of claim 27, wherein the suction operated dispenser device is a syringe.

29. The transfer device (2) of claim 1 further comprising luer connector (58) for connection to at least one of the sites.

30. The transfer device (2) of claim 29, wherein the luer connector (58) comprises a luer lid (60), a luer plunger (62) and a spring (64) being supported by the housing (4) and forcing the luer plunger (62) against the luer lid (60) so as to close the luer connector (58).

31. The transfer device (2) of claim 29, wherein the first site comprises a collar (112) or a cap assembly (102) mounted to the first site with which the wings (6, 8) are engagable.

32. A method for transferring fluid from a first site to a second site using the transfer device (2) of claim 1.

33. A cap assembly (102) for use with a container (106) and a transfer device, particularly a transfer device (2) of claim 1, said cap assembly (102) comprising:

a) a sleeve (104) having an inner surface provided with at least two axially spaced and radially inwardly extending protrusions (108, 110) that are adapted to receive a radially outwardly extending collar (112) of the container (106) therebetween so as to secure the cap assembly (102) at the container (106), and an outer surface provided with at least two axially spaced annular grooves (124, 126) and at least one recess (130); and b) a cap (114) having a locking ring (116) and a removable cap portion (118), the locking ring (116) comprising at least one inwardly extending protrusion (122) being adapted to mate with said annular grooves (124, 126) provided on the outer surface of the sleeve (104).

34. The cap assembly (102) of claim 33, wherein the locking ring (116) and the removable cap portion (118) are interconnected by a line of weakness (128) that is adapted to break upon removal of the cap portion (118).

35. The cap assembly (102) of claim 34, wherein the locking ring (116) removably holds the cap portion (118) by a thread.

36. The cap assembly (102) of any claim 35, wherein the locking ring (116) is elastically deformable so that the inwardly extending protrusion (122) of the cap (114) snaps into at least one of the grooves (124, 126).

37. The cap assembly (102) of claim 36, wherein the recess (130) provided on the outer surface of the sleeve (104) is formed as an annular groove.

38. The cap assembly (102) of claim 37, wherein the recess (130) provided on the outer surface of the sleeve (104) is adapted to mate with an engaging means (10, 12) provided at the transfer device (2).

39. The cap assembly (102) of claim 38, wherein one of the two axially spaced annular grooves (126) is located adjacent a lower end of the sleeve (104) and the at least one recess (130) is located adjacent an upper end of the sleeve (104), while the other groove (124) is positioned relatively close to the at least one recess (130).

40. The cap assembly (102) of claim 39, wherein the sleeve (104) comprises a stop member (132) forming an abutment for the locking ring (116).

41. A method of mounting the cap assembly (102) of claim 40 to a container (106) comprising the steps of:

a) pushing the cap assembly (102) onto a collar (112) of a neck provided on the container (106) so that the collar (112) is accommodated between the two inwardly extending annular protrusions (108, 110) of the sleeve (104), while the cap (114) is in a mounting position in which the inwardly extending protrusion (122) of the locking ring (116) is engaged with an upper one of the two grooves (124) formed on sleeve (104); and b) pushing the cap (114) from the mounting position into a locking position in which the cap assembly (102) is secured to the container (106), wherein in the locking position the inwardly extending protrusion (122) of the locking ring (116) is engaged with a lower one of the two grooves (124, 126) formed in the sleeve (104).

42. The method of claim 41 comprising the additional step of:

removing the cap portion (118) of the cap (114) from the locking ring (116) so as to expose the at least one recess (130) for engagement with engaging means (10, 12) of a transfer device (2).

* * * * *

UNITED STATES PATENT AND TRADEMARK OFFICE

CERTIFICATE OF CORRECTION

PATENT NO. : 7,140,401 B2
APPLICATION NO. : 10/498831
DATED : November 28, 2006
INVENTOR(S) : Wilcox et al.

It is certified that error appears in the above-identified patent and that said Letters Patent is hereby corrected as shown below:

On the Title page, Item (30) Foreign Application Priority Data

"Aug. 20, 2002 (EP) .....02018206" should read:

-- Aug. 20, 2002 (EP) .....02018206.9 --

Signed and Sealed this

Fifteenth Day of April, 2008

JON W. DUDAS
*Director of the United States Patent and Trademark Office*